United States Patent [19]

MacNamara

[11] 3,955,967

[45] May 11, 1976

[54] TREATMENT OF STEEL

[75] Inventor: John MacNamara, Sault Ste. Marie, Canada

[73] Assignee: The Algoma Steel Corporation, Limited, Sault Ste. Marie, Canada

[22] Filed: May 20, 1974

[21] Appl. No.: 471,741

Related U.S. Application Data

[63] Continuation-in-part of Ser. No. 358,227, May 8, 1973, abandoned.

[30] Foreign Application Priority Data

May 2, 1973 Canada ..... 170265

[52] U.S. Cl. ..... 75/58; 75/53; 75/93 G

[51] Int. Cl.[2] ..... C21C 7/06; C22B 9/10

[58] Field of Search ..... 75/53–58, 75/129, 46, 93 G

[56] References Cited

UNITED STATES PATENTS

| | | | |
|---|---|---|---|
| 1,119,643 | 12/1914 | Saklatwalia | 75/93 G |
| 1,275,449 | 8/1918 | Lemon | 75/93 G |
| 1,899,152 | 2/1933 | Jeavons | 75/93 G |
| 2,633,438 | 3/1953 | Uhle | 75/58 |
| 3,438,820 | 4/1969 | Goss | 75/60 |
| 3,467,167 | 9/1969 | Mahin | 75/58 |
| 3,634,075 | 1/1972 | Hoff | 75/58 |
| 3,729,309 | 4/1973 | Kawawa | 75/129 |
| 3,738,827 | 6/1973 | Pryor | 75/53 |

*Primary Examiner*—Peter D. Rosenberg
*Attorney, Agent, or Firm*—Ladas, Parry, Von Gehr, Goldsmith & Deschamps

[57] ABSTRACT

The treatment, preferably sulphide modification of molten steel in the ladle, which treatment is effected by the addition of an agent which is normally highly reactive to oxygen, such as rare earth metal compounds, particularly rare earth metal silicides, thereto after a desired amount of deoxidation of the molten steel has taken place, preferably after substantially complete deoxidation of said molten steel in which addition agent is enclosed in at least one metal, preferably steel container suspended in the molten steel in the ladle such that at least that portion of the container containing the addition agent is disposed below the surface of the molten steel in the ladle whereby the addition agent is distributed into the molten steel on melting of the walls of the container, the thickness of the walls of the container being selected to provide the required delay in the introduction of the addition agent in said steel for the desired amount of deoxidation of the steel to have taken place in the ladle.

11 Claims, 3 Drawing Figures

TREATMENT OF STEEL

This application is a continuation-in-part of application Ser. No. 358,227 filed May 8, 1973, now abandoned.

The present invention relates to the treatment of steel and preferably sulphide modification of steel. In particular, the present invention relates to the treatment of and preferably sulphide modification of molten steel in the ladle suitably during transportation of the molten steel from the steel making furnace for casting thereof, which treatment is effected by the addition of addition agents which usually have a high affinity for oxygen thereto particularly rare earth metal values, e.g. rare earth metal silicides thereto.

It is well known in the steel making industry that the presence of stringer sulphide inclusions is detrimental to the ductility of steel, particularly the transverse notch toughness of the steel, and it is conventional to modify the sulphides contained in molten steel obtained from the steel making furnace to less harmful rounded inclusions. Sulphide modification of the molten steel has been found to be effectively achieved by the addition of rare earth metal values, such as rare earth metal silicides thereto. However, such sulphide modifying agents are only effective when the molten steel has been killed, i.e. deoxidized, as the rare earth metals are highly reactive with oxygen. The deoxidation of the steel is normally effected in the ladle by the presence of deoxidizing agents therein, such as aluminum, which is normally introduced into the ladle during the tapping of the molten steel therein from the steel making furnace. The rare earth metal values are therefore added to the molten steel in the ladle after a time delay sufficient to allow the aluminum to effect the deoxidation of the molten steel in the ladle.

Heretofore the rare earth metal values, e.g. silicides have inter alia been added to the molten steel in the ladle by simply throwing or injecting the rare earth metal values onto or under the surface of the molten steel in the ladle. This procedure however is highly inefficient due inter alia to the high affinity of the rare earth metals for oxygen in the steel, oxygen in the metal oxides constituting the slag cover, and problems have been experienced with a lack of uniform distribution of the rare earth metal values.

It has also been proposed as will be seen from Canadian Pat. No. 608,336 issued Nov. 8, 1960 to Union Carbide Corporation, Canadian Pat. No. 530,556 issued Sept. 18, 1956 to Molybdenum Corporation of America, and U.S. Pat. No. 2,915,386 issued Dec. 1, 1959 to Vanadium Corporation of America to supply additives beneath the surface of a molten metal bath by enclosing the additives in a closed metal container and disposing the container in the metal bath on the basis that the specific gravity of the container being greater than that of the metal bath the container will sink in the metal bath beneath the surface thereof and thus distribute the additives beneath the surface of the bath. However, particularly with light additives of low specific gravity, such as rare earth metal silicides there is a tendency as the heavier metal of the container wall is dissolved thereof in the bath for the container to rise to the surface of the bath before there has been significant distribution of the additives in the bath with the result that the additives come into contact with the slag in the surface of the molten steel in the ladle and also are volatilized. As such, commercial utilization of this method for the addition of additives of low specific gravity such as rare earth metal compounds to the molten steel in the ladle has not been successful.

In U.S. Pat. No. 3,322,530 issued May 30, 1967 to IshikawajimaHarima Jukogyo Kabushiki Kaisha there is disclosed a method of increasing the nitrogen content of steel by adding a nitrogen enrichment agent such as calcium cyanimide to molten steel in the ladle during tapping of the molten steel from a furnace by means of a transport pipe which extends through the slag on the steel surface and is consumed (melted) by the molten metal in the bath at a rate approximately the same as the rate of rise of molten metal in the ladle as it rises in the ladle. This method is alleged to increase the efficiency of the process in that excessive losses to the slag of the agent are reduced. This method is unsuitable for the addition of rare earth metal silicides to the molten steel in the ladle as the molten steel has not been fully deoxidized in the ladle and gives poor recoveries.

The present invention provides a method of treatment of, particularly sulphide modification of, molten steel in the ladle in which the addition agents which are normally highly reactive with oxygen, are added to a molten steel which is preferably substantially completely deoxidized in the ladle beneath the surface thereof so as to effect an improved utilization and distribution of the additive in the treatment of the molten steel.

It has now been found according to the present invention that the additives, particularly those of low specific gravity, which are readily oxidized may be introduced beneath the surface of the molten steel in the ladle by enclosing the additive in at least one metal container, preferably a steel container, and fixedly suspending the container in the ladle such that at least those portions of the container containing the additive are disposed beneath the surface of the molten steel in the container whereby on melting of said metal container, the additives are distributed into the molten steel, the thickness of the walls of the container being selected to provide the required delay before release of the additive suitably to allow for the desired amount of deoxidation of the steel to have taken place.

According to one aspect of the present invention therefore, there is provided in the treatment of molten steel by the addition of at least one addition agent which is normally reactive with oxygen to said molten steel in a ladle during transportation of said molten steel from a steelmaking furnace for casting thereof, the improvement which comprises enclosing the addition agent in a metal container, and fixedly suspending said container in said ladle to submerge at least that portion of said container containing said addition agent so as to melt said container and release said addition agent beneath the surface of said molten steel in said ladle, said container having walls of selected thickness to provide the required time delay in releasing said addition agent into said molten steel to allow for the desired amount of deoxidation of the steel to have taken place.

In a particularly advantageous embodiment of the present invention, the additive comprises rare earth metal values particularly rare earth metal silicides for the modification of sulphides in the steel in the ladle, the time delay being sufficient for substantially complete deoxidation of the steel to have taken place.

According to a particularly preferred embodiment of the present invention, therefore, there is provided in the sulphide modification of molten steel by the addition of at least one rare earth metal value to a substantially completely deoxidized molten steel in a ladle during transportation of said molten steel from a steelmaking furnace for the casting thereof, the improvement which comprises enclosing the rare earth metal value in a metal container, suspending said container in said molten steel in said ladle to submerge at least that portion of the container containing said rare earth metal values and release said powdered rare earth metal values beneath the surface of said molten steel in said ladle on melting of said container, said container having walls of a selected thickness to provide the required time delay in releasing said powdered rare earth metal values for substantially complete deoxidation of the molten steel to have taken place.

Whilst the particularly preferred embodiment of the present invention relates to the use of rare earth metal values, particularly rare earth metal silicides, to a substantially completely deoxidized molten steel for sulphide modification thereof, the present invention provides in general for the addition of other additives particularly additions which have a strong affinity of oxygen such as boron compounds, calcium metal, and alloys, e.g. calcium alloys and deoxidizers to the molten steel which is preferably deoxidied.

The present invention also provides a device for use in the treatment of molten steel in a ladle during transportation of the molten steel from a steelmaking furnace for casting thereof by the addition of agents which are normally strong deoxidizing agents thereto, said device comprising a yoke adapted to extend across the open top of said ladle and at least one hollow tube closed at one end thereof for containing the addition agent, the tube fixedly mounted in said yoke such that when said yoke is in position on said ladle each said tube is suspended vertically in said ladle with at least that portion of the tube adjacent the closed end thereof containing the addition agent being submerged in molten steel contained in said ladle, each said tube being of preselected wall thickness to provide a selected time delay in releasing said addition agents into the molten steel in said ladle after initial contact of each said tube with said molten metal suitably to allow for the desired amount of deoxidation to have taken place.

The metal container is fabricated of a metal which is compatible with the steel and is preferably a steel container.

It is a critical feature of the present invention that the container containing the additive be fixedly suspended in the ladle with that portion containing the additive disposed beneath the surface of the steel bath. This ensures that the additive is released beneath the surface of the bath and not on the surface of the bath and further that the distribution pattern of the additive in the molten steel can be selected to best advantage.

In a preferred embodiment of the present invention the container takes the form of a hollow tube suspended from a yoke extending across the open top of the ladle closed on the bottom end thereof. There can be a plurality of such tubes suspended from said yoke and horizontally spaced so as to improve the distribution of the additive, particularly the rare earth metal silicides, in the molten metal in the ladle.

It is also critical to the process of the present invention that the thickness of the walls of the container are such as to provide a required time delay for the desired amount of deoxidation to have taken place and particularly in the sulphide modification of the steel, for substantially complete deoxidation of the molten steel in the ladle to have taken place before release of the rare earth metal values. This thickness can be readily determined experimentally.

In one embodiment of the present invention, the containers may be suspended in the ladle before or during tapping of the molten steel in the ladle. In such a case the walls must have sufficient thickness to withhold release of the addition agents until the deoxidation agents have had sufficient time to effect the required deoxidation of the steel.

In an alternative embodiment of the present invention the container may be submersed in the ladle after completion of tapping of the molten steel therein and suitably after the required deoxidation thereof has taken place. In such a case the walls of the container may be substantially thinner and be sufficient to prevent release of the addition agents until the containers are in place in the bath, e.g. until they have passed through the slag on the top of the steel in the ladle.

The present invention will be further illustrated by way of the accompanying drawings in which.

Figure 1:
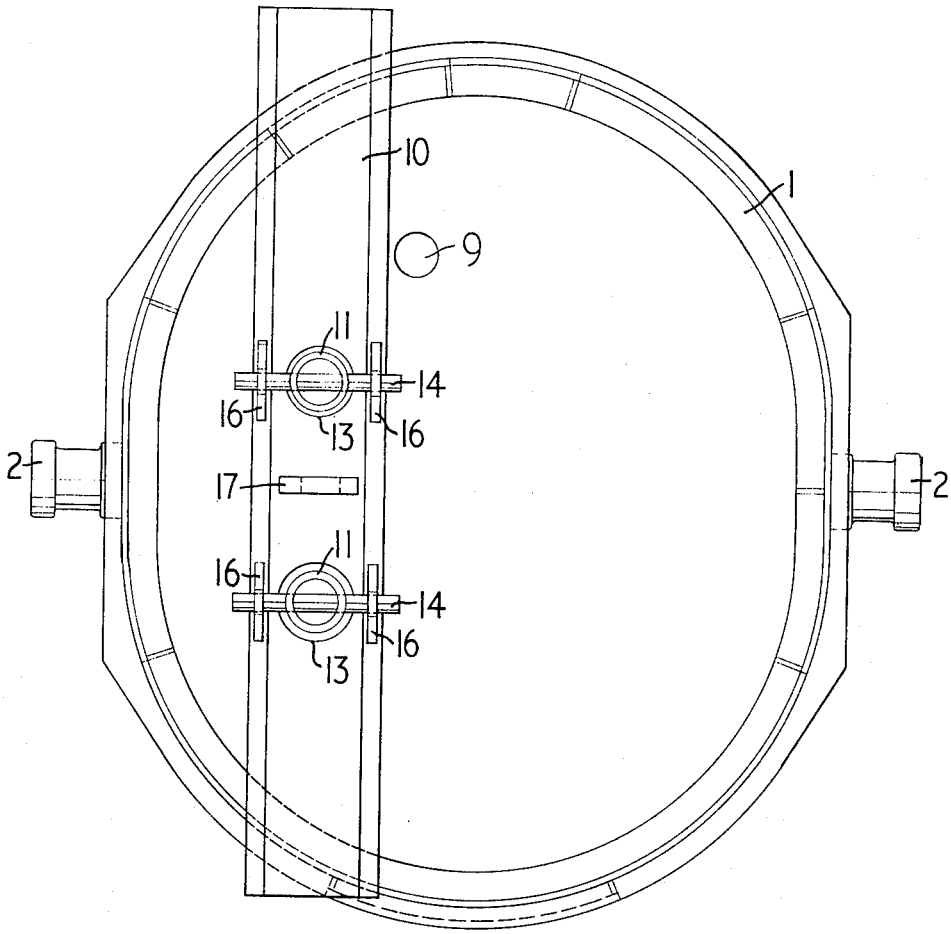
FIG. 1 is a plan view of a device in accordance with one embodiment of the present invention for use in sulphide modification of steel in a conventional ladle used in the transportation of steel from a steelmaking furnace for casting thereof.
Figure 3:
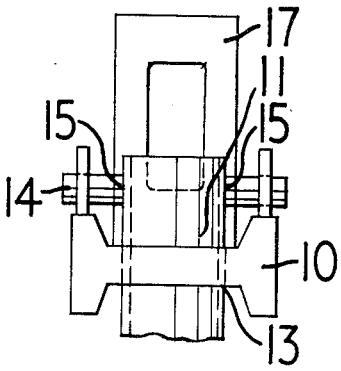
FIG. 3 is a detail end elevation of the device of FIG. 1.
Figure 2:
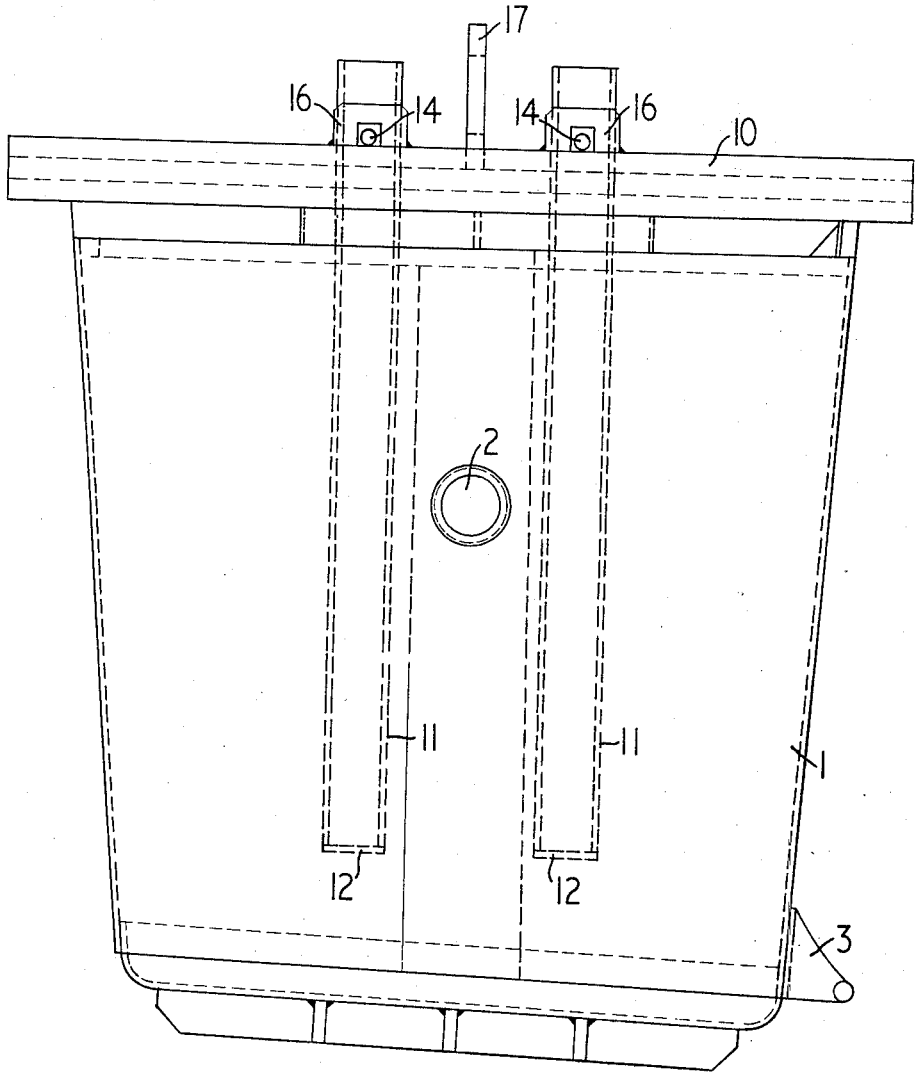
FIG. 2 is a side elevation of the ladle including the device in accordance with FIG. 1.

Referring to the drawings, the ladle 1 is a conventional ladle used in the transportation of steel from a steelmaking furnace for casting thereof includes stopper 9 and is carried from the furnace to the casting section suspended from a crane on its trunnions 2. As the ladle is a conventional ladle well known in the steel industry, it will not be described in any further detail.

In accordance with the present invention, a yoke 10 in the form of a steel I-beam rests across the open mouth of the ladle 1 on the lips thereof. The yoke 10 fixedly suspends a pair of spaced steel tubes 11 vertically in the ladle 1. The lower end of each of the tubes 11 is closed by an end plate 12 and thus the tubes may contain rare earth metal silicides. The tubes 11 are retained in the yoke 10 and extend through holes 13 therein by means of removable steel pegs 14 which extend through holes 15 in the open end of the tubes 11 and through retaining brackets 16 welded to the I-beam from the yoke 10. The device is located in position in the ladle 10 by means of a crane which lifts the yoke 10 by means of brackets 17 and locates the I-beam across the open mouth of the ladle.

In operation of the process according to a preferred embodiment of the present invention for the sulphide modification of steel in accordance with one embodiment of the invention, the device in which the tubes 11 contain rare earth metal silicides is suspended in the ladle as shown in the drawings and subsequently molten steel is tipped into the ladle from the steelmaking furnace together with a deoxidizing agent such as aluminum, ferromanganese and ferrosilicon. The thickness of the walls of the tubes 11 is sufficient to provide a required time delay after contact of the walls of the tubes 11 with molten steel which submerges at least that portion of the tubes 11 containing the rare earth metal silicides. This time delay is sufficient for the deoxidizing agent to fully kill the steel.

The following example will further illustrate the embodiment of the present invention.

A heat was produced in a basic oxygen furnace of nominal 100 ton capacity. It was desired to produce plate to meet a minimum yield strength of 65,000 psi and notch toughness of minimum Charpy impact energy (heat average based on ⅔ size transverse specimen of 0°F) of 30 ft. lbs. To attain these minimum requirements it is necessary to desulphurize the steel to a level of 0.012% sulphur and to modify the sulphide inclusion morphology by treatment with rare earth elements.

Prior to tapping the furnace into the ladle a yoke, as previously discussed, was assembled suspending two 10 foot long 11 inch diameter steel pipes each having a wall thickness of one-half inch. Before assembling, each pipe had been filled with about 650 lbs. of rare earth silicide which contained approximately 30% of contained rare earth elements. The space in the pipes above the top level of the rare earth silicide was filled with lime. The wall thickness of the pipes had been so designed that the steel pipes at their lower extremity will melt whereby the rare earth's silicide are released well below the level of molten steel in the ladle during the pour from the furnace. Furthermore, the upper regions of the pipes do not melt until a discrete time interval after completion of the tap from the furnace and after the artifical slag cover has been formed.

At the time of tapping the furnace into the ladle, the following ladle additions were made.

340 lbs aluminum
3800 lbs Ferromanganese
330 lbs Ferrocolumbium
250 lbs Lime

In addition, 700 lbs of fly ash was added to the ladle at the end of the tap to provide the artifical slag cover.

The temperature of the steel after all additions were made was 2855°F. Prior to teeming the melt into ingot molds the steel in the ladle was stirred with an argon gas injector for about 7 minutes to achieve a uniform distribution of the additions made and to equalize the temperature for teeming at 2840°F.

The final steel analysis was 0.14%C, 1.50% Mn, 0.01% S, 0.005% P, 0.15% Si, 0.06% Cb and 0.07% Al. After rolling the following properties of the steel were attained:

| | |
|---|---|
| Yield Strength | 76,000 psi |
| Tensile Strength | 91,000 psi |
| Elongation in 2" | 36% |
| Charpy Impact Energy (based on ⅔ size traverse specimen tested at 0°F) | 70 ft. lbs. |

From the analysis and properties attained it would be obvious that good sulphide modification was effected and full value obtained from the rare earth silicide addition.

In an alternative embodiment of the process of the present invention, the steel is tipped into the ladle from the steelmaking furnace together with the deoxidizing agent and the device is subsequently lowered into the ladle so as to submerge the tubes 11 whence the melting of the walls of the tubes release the rare earth metal silicides into the steel beneath the surface of the slag and provide for a distribution of the rare earth metal silicides in the steel. In each embodiment described good distribution of the rare earth metal silicides and other additives having a strong affinity for oxygen is assisted by argon stirring the ladle immediately prior to teeming the steel into the ingot moulds.

The embodiments of the invention in which an exclusive property or privilege is claimed are defined as follows:

1. In the treatment of molten steel by the addition of at least one addition agent which has a high affinity for oxygen to said molten steel in a ladle during transportation of said molten steel from a steelmaking furnace for casting thereof, the improvement which comprises adding a deoxidizing agent to the molten steel, enclosing the addition agent in a metal container, and fixedly suspending said container in said ladle to submerge at least that portion of said container containing said addition agent so as to melt said container and release said addition agent beneath the surface of said molten steel in said ladle, said container having walls of sufficient thickness to provide a time delay in releasing said addition agent into said molten steel such that deoxidation of the steel by the deoxidizing agent is substantially completed before the addition agent is released.

2. A method as claimed in claim 1 in which said container is fixedly suspended in said ladle before tapping of molten steel into said ladle from said furnace.

3. A method as claimed in claim 1 in which said container is fixedly suspended in said ladle which already contains said molten steel.

4. A method as claimed in claim 1 in which each container is a hollow tube suspended from a yoke extending across the open top of said ladle.

5. A method as claimed in claim 4 in which there are a plurality of such tubes horizontally spaced in said yoke.

6. A method as claimed in claim 1 in which the rare earth metal value is a rare earth metal silicide.

7. A method as claimed in claim 1 in which the metal container is a steel container.

8. A method as claimed in claim 1 in which the addition agent is a boron compound, calcium metal, or any other metal alloy or compound having a strong affinity for oxygen.

9. A method as claimed in claim 1 in which the addition agent is a rare earth metal values.

10. A method as claimed in claim 1 in which the deoxidizing agent is aluminum.

11. A method as claimed in claim 1 in which the deoxidizing agent is introduced into the ladle during tapping of the molten steel.

* * * * *